United States Patent [19]

Porter

[11] Patent Number: 4,861,192

[45] Date of Patent: Aug. 29, 1989

[54] MARINE CRAFT LIFT

[76] Inventor: Glenn A. Porter, 604 Washington St., Woodstock, Ill. 60098

[21] Appl. No.: 224,337

[22] Filed: Jul. 26, 1988

[51] Int. Cl.[4] ..... B63C 1/08

[52] U.S. Cl. ..... 405/3; 405/4; 405/7; 254/336; 254/389; 254/394

[58] Field of Search ..... 405/3, 4, 7; 114/43, 114/45, 48; 414/678, 680; 254/387, 389, 338

[56] References Cited

U.S. PATENT DOCUMENTS

| | | | |
|---|---|---|---|
| 710,170 | 9/1902 | Weindorf | 405/7 X |
| 3,284,052 | 11/1966 | Godbersen | 405/3 |
| 4,019,212 | 4/1977 | Downer | 405/3 X |
| 4,401,335 | 8/1983 | Godbersen | 414/690 X |
| 4,509,446 | 4/1985 | Sutton | 405/3 X |
| 4,641,596 | 2/1987 | Reprogle et al. | 405/3 X |
| 4,686,920 | 8/1987 | Thomas | 405/4 X |
| 4,787,327 | 11/1988 | Porter | 405/3 X |

FOREIGN PATENT DOCUMENTS

| | | | |
|---|---|---|---|
| 262642 | 1/1970 | U.S.S.R. | 254/389 |

*Primary Examiner*—Dennis L. Taylor
*Assistant Examiner*—J. Russell McBee
*Attorney, Agent, or Firm*—Wood, Dalton, Phillips Mason & Rowe

[57] ABSTRACT

An apparatus for elevating objects and consisting of a frame for bearing on a subjacent support surface for the apparatus, a platform having an upwardly facing surface for bearing against an object to be elevated and laterally spaced sides and mounted to the frame for movement relative to the frame in a vertical direction between a lowered position and a raised position, a flexible cord, a winch mounted on the frame for selectively retrieving and paying out the cord, an elongate hollow conduit with spaced opposite ends mounted to the platform so that the conduit length is aligned laterally with respect to the platform, and wherein the cord extending from the spaced opposite ends of the conduit is connected to the winch and frame so that as the line is retrieved by the winch a lifting force is exerted on the conduit to elevate the platform.

18 Claims, 5 Drawing Sheets

PRIOR ART

FIG. 2
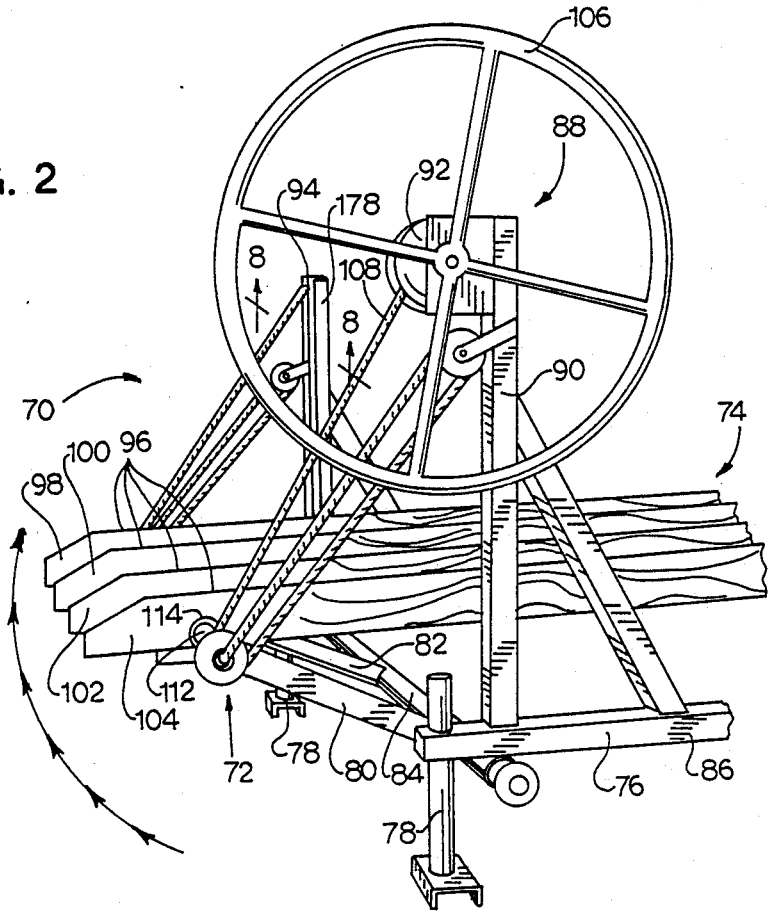
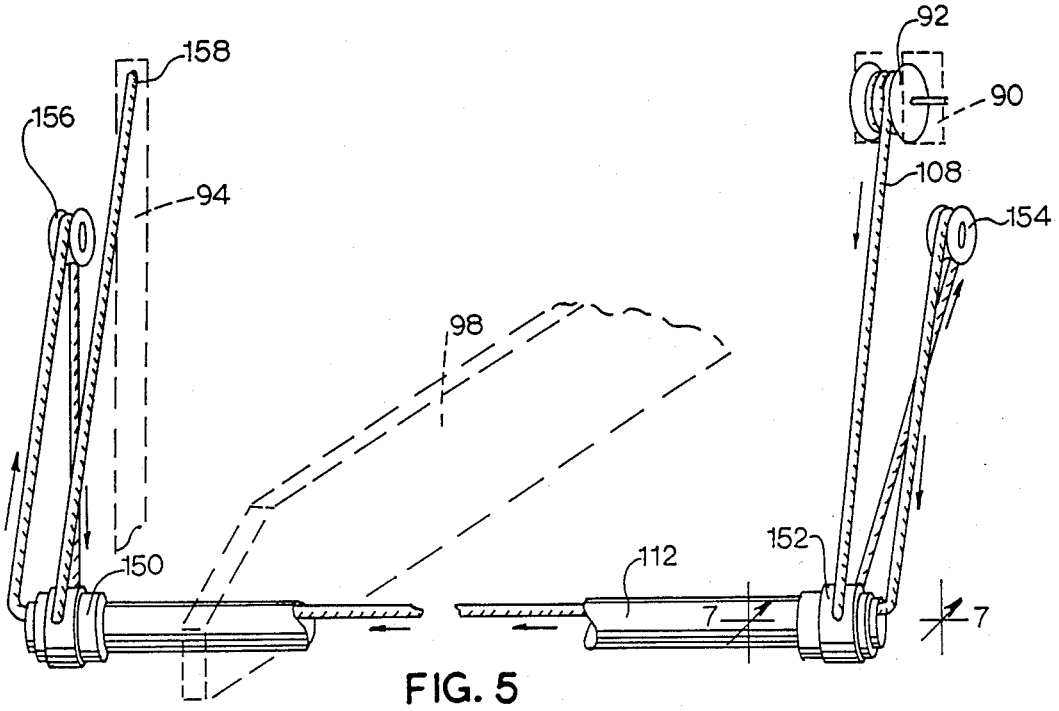
FIG. 5

FIG. 9
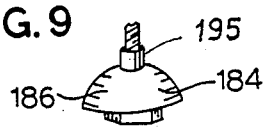
FIG. 8
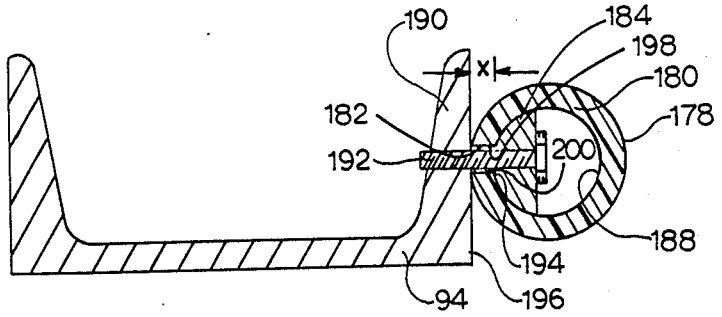
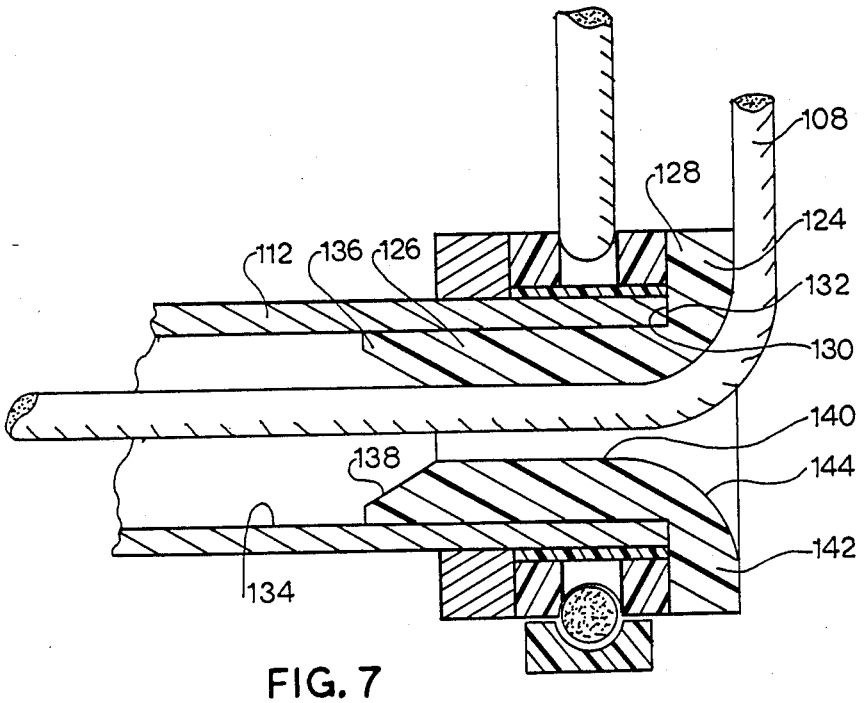
FIG. 7

MARINE CRAFT LIFT

BACKGROUND OF THE INVENTION

Field of the Invention

This invention relates to lifts for elevating objects and, more particularly, to a lift for a marine craft.

Background Art

It is desirable to store marine craft out of water for various reasons and particularly because such storage may lengthen the life of the hull. Deterioration of the hull due to marine life accumulation is obviated Further, the raised hull will not be subjected to rough water which might throw the craft against its mooring or cause it to overturn.

Designers of boat lifts strive towards simplicity, compactness, and ease of operation, which objectives are often competing.

One type of prior art boat lift is shown in U.S. Pat. No. 4,318,632, to Fortmeyer. In Fortmeyer, a boat support platform is connected to a frame for pivoting movement relative to the frame between lowered and raised positions. A lifting force is imparted through a cable, which is retrievable by a winch. In Fortmeyer, there is a concentration of the lifting force on only one side of the platform. If the weight of the boat is substantial this lifting force tends to skew the structure, with obvious detrimental results.

An alternative type of prior art lift is shown in U.S. Pat. No. 4,022,027, to Tetzner. In Tetzner, a lifting force is imparted to a pivotable platform at a location centered between the sides of the platform. While Tetzner exerts a balanced lifting force, he requires an obtrusive frame in front of the platform to be able to develop the substantial lifting force that must be applied to the platform to effect elevation thereof.

U.S. Pat. No. 4,027,492, to Carpenter, discloses a pulley arrangement to distribute and reduce the requisite platform lifting force. However, the Carpenter structure has two noticeable drawbacks. First, the pulleys shown are of conventional construction and submerged in water with the platform lowered. The pulley are prone to being tangled with seaweed and other objects suspended in the water and are also likely to rust. Further, the cable is shown to be crossed from side to side on the apparatus. There is thus the potential of entangling the craft to be lifted and the cable.

U.S. Pat. No. 4,469,346, to Low, discloses a structure wherein the same problems associated with an exposed lifting cable are apparent.

SUMMARY OF THE INVENTION

The present invention is specifically directed to overcoming the above enumerated problems in a novel and simple manner.

The present invention comprehends an apparatus for elevating objects and consisting of a frame for bearing on a subjacent support surface for the apparatus, a platform having an upwardly facing surface for bearing against an object to be elevated and laterally spaced sides and mounted to the frame for movement relative to the frame in a vertical direction between a lowered position and a raised position, a flexible cord, a winch mounted on the frame for selectively retrieving and paying out the cord, an elongate hollow conduit with spaced opposite ends mounted to the platform so that the conduit length is aligned laterally with respect to the platform, and wherein the cord extending from the spaced opposite ends of the conduit is connected to the winch and frame so that as the line is retrieved by the winch a lifting force is exerted on the conduit to elevate the platform.

With the inventive structure, the lifting force can be distributed laterally along the platform without the use of conventional eyelets or the like.

In a preferred form, the conduit encasing the cable is beneath the platform lifting surface. Accordingly, the cable will not become entangled with weeds, nor will it be exposed to the marine craft or other object being lifted by the platform.

In a preferred form, cord guide inserts are mounted in the spaced ends of the conduit. The cord applies an even force to the inserts to raise the conduit and in turn elevate the platform.

In the simplest form of the invention, the cord extends downwardly from the winch on one side of the platform, through the conduit, and upwardly on the other side of the platform where it is anchored to the frame. The lifting force is thus evenly laterally distributed without the need for pulleys and/or eyelets, as in the prior art.

It is also possible to reduce the requisite lifting force on the cord by doubling the cord back through the conduit. With this arrangement, the cord is directed from the winch on one side of the platform through the conduit, around a pulley or eyelet on the frame on the other side of the platform, doubled back through the conduit and anchored on the frame on the same side of the platform as the winch is located. The pulley on the frame side opposite the winch can be sufficiently high that it need not be submerged and thus the problems of the pulley rusting and/or entangling with weeds are obviated.

The invention also comprehends the use of more than one pulley and further the use of a pulley that surrounds and is coaxial with a cylindrical portion of the conduit. Such a pulley arrangement is positively mounted and not as prone to failure in the marine environment as are conventional pulleys.

BRIEF DESCRIPTION OF THE DRAWINGS

FIG. 2 is a fragmentary perspective view of a modified form of marine craft lift with a platform lift mechanism according to the present invention and operable by a flexible cord;

FIG. 5 is an enlarged perspective view of the platform lift mechanism in FIG. 2;

FIG. 7 is an enlarged section view of the lift mechanism taken along line 7—7 of FIG. 5;

FIG. 8 is a section view of a bumper assembly on a frame of the marine craft lift taken along line 8—8 of FIG. 2; and FIG. 9 is a perspective view of an insert on the bumper assembly of FIG. 8.

DETAILED DESCRIPTION OF THE DRAWINGS

The present invention is directed to an apparatus for elevating objects. It has particular utility in marine craft lifts such as that shown in FIG. 1, at 10.

Figure 1:
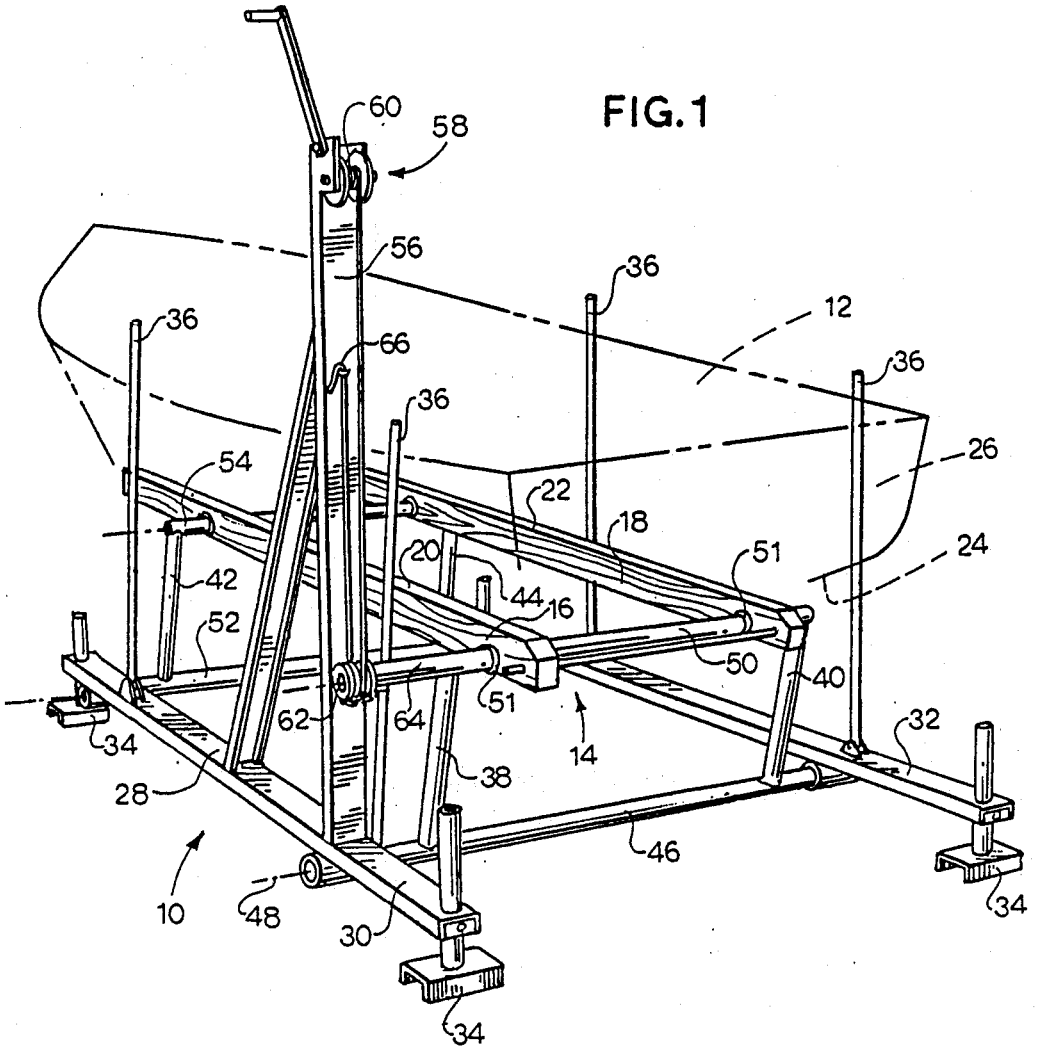
FIG. 1 is a perspective view of a prior art marine craft lift suitable for incorporation of the present invention and shown with a craft supported on a vertically movable lift platform.

In FIG. 1, a water craft 12 is shown resting atop the lift, which is shown in a raised position. The lift 10 comprises a platform at 14 consisting of laterally spaced, elongate rails 16, 18 having upwardly facing surfaces 20, 22, respectively, for simultaneously bearing on the underside 24 of the craft hull 26.

The platform 14 is mounted for pivoting movement relative to a fixed frame 28. The frame 28 consists of two elongate, laterally spaced beams 30, 32, with associated pads 34 for bearing on a subjacent surface supporting the lift 10. The beams 30, 32 carry upright guide poles 36, which cooperatively keep the craft 12 centered between the sides of the lift 10.

The platform 14 is mounted for movement relative to the frame 28 by two pairs of lifting arms 38, 40 and 42, 44, at the rear and the front of the frame respectively. The rear lifting arms 38, 40 are connected at their lower ends to a first cross bar 46, that is pivotally connected at its ends to the beams 30, 32 for rotation relative thereto about a laterally extending, substantially horizontal axis 48. The upper ends of the rear lifting arms 38, 40 are attached to a laterally extending conduit 50, which is directed through the platform rails 16, 18 and pivotally connected thereto. Axially spaced flanges 51 on the conduit 50 maintain the spacing between the rails 16, 18. A corresponding front cross bar 52 and conduit 54 are attached to the front lifting arms 42, 44 in like fashion.

The lifting arms 38, 40, 42, 44, cross bars 46, 52 and conduits 50, 54 cooperatively support the rails 16, 18 for movement relative to the frame 28 between raised and lowered positions. Upon the rails 38, 40, 42, 44 pivoting clockwise in FIG. 1, the rails 16, 18 are caused to move simultaneously rearwardly and downwardly, while counterclockwise rotation of the lifting arms 38, 40, 42, 44 shifts the platform forwardly and upwardly. With the craft 12 in place on the lift 10, the weight of the craft 12 normally urges the lifting arms 38, 40, 42, 44 in a clockwise direction, i.e. towards the lowered position for the platform 14.

To control pivoting of the platform 14, the frame 28 is provided with a fixed, upright boom 56, having a generally inverted V-shape and a winch 58 at the top thereof carrying a supply of flexible cord 60. The cord 60 extends from the winch 58 around a pulley 62 at the free end 64 of the conduit 50 projecting from one side of the platform 14 and has its free end 66 conventionally anchored to the boom 56 below the winch 58. By retrieving cord 60 on the winch 58, the platform 14 is caused to be raised through counterclockwise pivoting of the lifting arms 38, 40, 42, 44, while paying out the line from the winch 58 achieves the opposite result.

In operation, the craft 12 is lowered from the FIG. 1 position by releasing cord 60 from the winch 58. The platform 14 is lowered sufficiently that the craft 12 will be buoyed in the water and it can be readily directed over the rails 16, 18 and thereby on and off of the platform 14. The craft 12 to be lifted is directed between the guide posts 36 until the craft 12 situates in the proper fore and aft position with respect to the rails 16, 18. The winch 58 is then operated to retrieve cord 60, thereby hoisting the craft 12 out of the water.

FIG. 2 depicts a lift 70 which operates in similar fashion to the lift 10 in FIG. 1, and has incorporated the inventive platform lifting mechanism at 72 at the rear of the lift 70. The lift 70 has a platform 74 to cradle a craft (not shown), a fixed frame 76 supported on feet 78, lifting arms 80, 82 connected to a cross bar 84 which in turn is pivotally connected to frame rails 86 (one shown) for relative pivoting movement about a horizontal and laterally extending axis, and a winch mechanism at 88 for selectively raising and lowering the platform 74.

According to the invention, a boom 90 is provided on the frame 76 on one side of the platform 74 to support a winch 92 and an upright 94 is provided on the frame 76 on the opposite side of the platform 74. The boom 90 and upright 94 both extend above the platform lifting surface 96, which is defined cooperatively by four laterally spaced rails 98, 100, 102, 104 and bears on the craft hull. A high torque wheel 106 is provided to operate the winch 92 and selectively retrieve and pay out a flexible cord 108.

Figure 3:
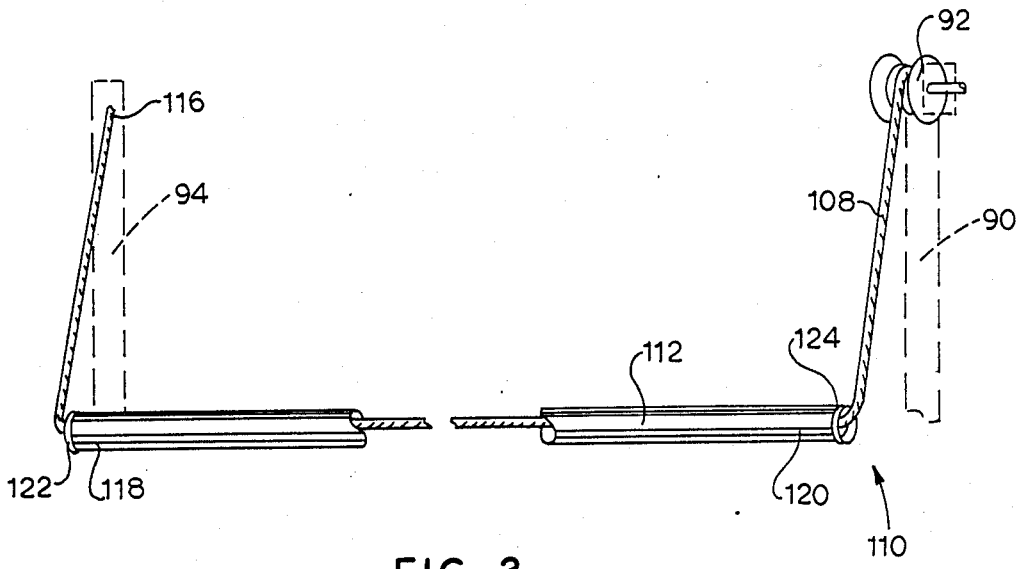
FIG. 3 is a perspective view of the simplest form of the modified platform lift mechanism.

In FIGS. 2–6, various arrangements for the cord 108 on the lifting mechanism according to the present invention are shown. The simplest version of lifting mechanism according to the present invention is shown in FIG. 3 at 110. The lifting mechanism at 110 consists of a conduit 112, having a hollow, generally cylindrical configuration and extending laterally through the lifting rails 98, 100, 102, 104 beneath the platform lifting surface 96. Conventional structure is used to maintain the lateral spacing of the rails 98, 100, 102, 104 along the length of the conduit 112 and at the same time allow relative rotation between the conduit 112 and rails 98, 100, 102, 104. For example, enlarged flanges 114 (one shown in FIG. 2) can be fixed to the conduit on opposite sides of the rails 98, 100, 102, 104.

In FIG. 3 the flexible cord 108 from the winch 92 is directed downwardly to the conduit 112, through the conduit 112 and back up to the upright 94 at a height approximately the same as that of the winch 92. The free end 116 of the cord 108 is fixedly secured in conventional manner to the upright 94. As the cord 108 is retrieved by the winch 92, the cord 108 bears upwardly on the conduit 112 along the lateral extent thereof. Accordingly, the lifting force is distributed evenly from side to side on the platform 74.

At the opposite ends 118, 120 of the conduit 112, inserts 122, 124, respectively, are provided. A representative one of the inserts 124 is shown in FIG. 7. The insert 124, which is preferably molded from a low friction plastic, has a cylindrical body 126 and a radially enlarged flange 128 at one end of the body 126. The flange 128 defines an axially facing shoulder 130, which abuts the free end 132 of the conduit 112 with the insert 124 in operative position. The insert 124 is friction fit within the conduit hollow 134. The axial end 136 of the insert 124 has a coaxial, truncated, conical cut-out 138 to permit slight radial deflection of the insert end 136 upon the end 136 being directed into the conduit hollow 134. The insert 124 has a through bore 140 which is flared at the axially outer end 142 thereof so as to thereby define a curved annular surface 144 against which the cord 108 can be bent, as shown in FIG. 7, in changing directions as it extends from the opposite conduit ends to the winch 92 and upright 94.

With the structure in FIG. 3, the cord 108 extending across the platform 74 is shielded by the conduit 112. Thus, the craft to be elevated will not entangle with the cord 108 as the craft is being placed on or removed from the lift 70. Further, the need for pulleys or eyelets where the cord 108 changes directions is obviated by the inserts 124. As previously noted, conventional type pulleys and eyelets would be submerged and thus prone to snagging in seaweed and deterioration due to rusting. Further, the elimination of pulleys and eyelets simplifies the overall structure.

Figure 4:
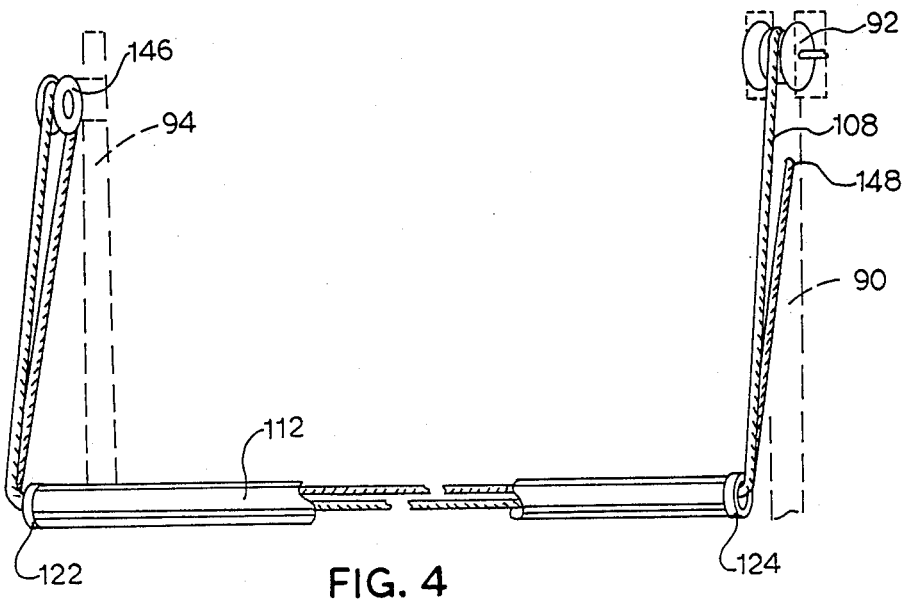
FIG. 4 is a perspective view of a further modified form of platform lift mechanism according to the present invention.

With the inventive lifting mechanism, it is further possible to increase the lifting capacity for the device without requiring submerged pulleys. An arrangement to accomplish this end is shown in FIG. 4, and this arrangement reduces by one half, over the structure in FIG. 1, the force that must be exerted on the cord 108 to raise the platform 74. In FIG. 4, the conduit 112 is connected to the platform 74 as in the FIG. 3 embodiment. The cord 108 is directed from the winch 92 through the conduit 112 and inserts 122, 124, around a pulley 146 on the upright 94, is doubled back through the conduit 112 and has its end 148 fixed to the boom 90 below the winch 92. With the FIG. 4 lifting mechanism, as with the FIG. 3 arrangement, no pulleys need be provided where they might be submerged.

Figure 6:
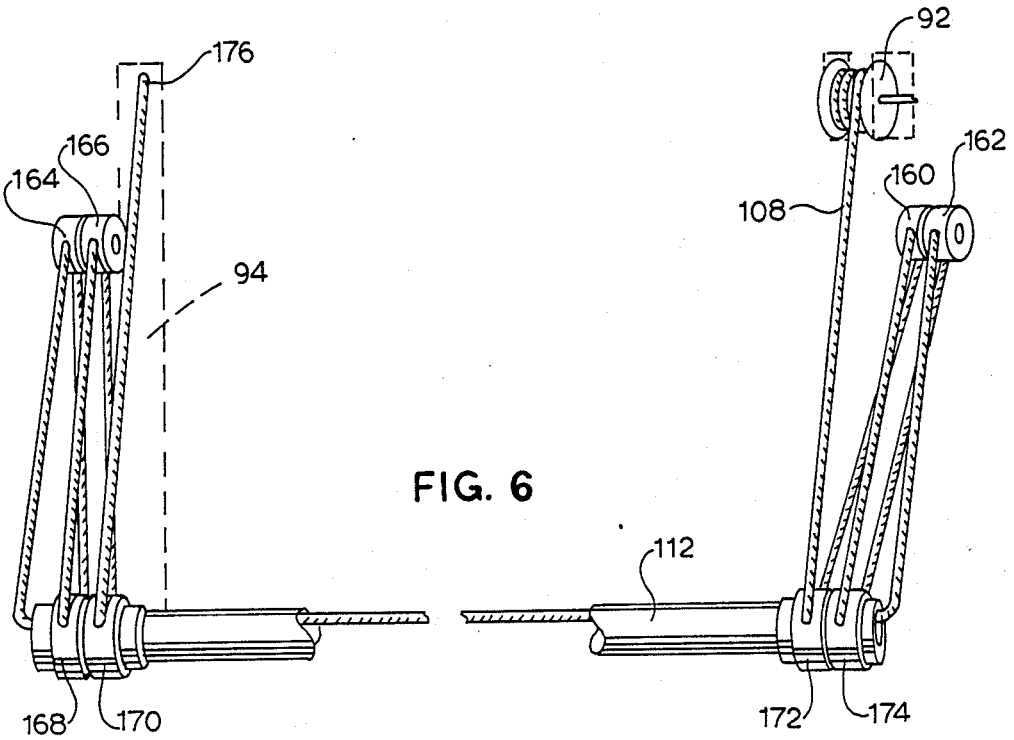
FIG. 6 is a perspective view of a still further modified form of platform lift mechanism according to the present invention.

It is also within the scope of the invention to further reduce the tension on the cord 108 by incorporating additional pulleys, as shown in FIGS. 5 and 6. In FIG. 5, pulleys 150, 152 are provided in coaxial, surrounding relationship with the conduit 112. The details of each of the pulleys 150, 152 are shown in my U.S. Pat. No. 4,787,327. In the FIG. 5 arrangement, the cord 108 is directed from the winch 92 consecutively around the pulley 152 at one end of the conduit 112, around a pulley 154 on the boom 90, through he conduit 112, around a pulley 156 on the upright 94, around the pulley 110 on the other end of the conduit 112 and back to the upright 94, where the free end 158 of the cord 108 is fixedly secured. With the FIG. 5 arrangement, the tension on the cable is one third that which it is in the FIG. 3 arrangement.

In FIG. 6, two pulleys 160, 162 are substituted for the pulley 154 in FIG. 5, two pulleys 164, 166 are substituted for the pulley 156 in FIG. 5, two pulleys 168, 170 are substituted for the pulley 150 in FIG. 5, and two pulleys 172, 174 are substituted for the pulley 152 in FIG. 5. In the FIG. 6 arrangement, the cord 108 is directed from the winch 92 consecutively around the pulleys 172, 160, 174, 162, through the conduit 112 and thereafter consecutively around pulleys 164, 168, 166 and 170 and the free end 176 of the cord 108 is anchored to the upright 94. The tension in the cord 108 in FIG. 6 is one fifth the tension in the cord 108 in FIG. 3. The invention also contemplates other arrangements of pulleys.

It can be seen that the cord 108 is positively shielded by the conduit 112 and the lifting force is evenly distributed from side to side on the platform 74 by the cord 108 bearing against the conduit 112 along its length. A simple yet effective lifting arrangement results.

To prevent contact directly between a craft and the upright 94 and boom 90, a bumper 178 is provided. The bumper 178 is shown in FIG. 2 on the upright 94 and details of the bumper 178 are shown in FIGS. 8 and 9. The bumper 178 consists of a hollow, resilient tube 180, preferably made of plastic. The tube 180 is slit along its length to define a slot 182. To secure the tube 180 to the upright 94, a series of connectors 184 is provided. The connector 184 has a hemispherical body 186 with a curvature approximately equal to the diameter of the bore 188 of the tube 180.

The connectors 184 are preassembled to one leg 190 of the upright 94 as through the use of bolts 192 extending therethrough. A spacing X is maintained between the nose 194 of each connector 184 and the facing wall surface 196 of the upright leg 190 by a cylindrical extension 195 of the connector body 186. The tube 180 is directed over the attached connectors by aligning the tube slot 182 with the cylindrical extensions 195 and forcing the extensions 195 into the slot 182. The facing surfaces 198, 200 bounding the slot squeeze the connector extensions 195 due to the resiliency of the tube 180. At the same time, the wall of the tube 180 is squeezed between the connector body 186 and the wall surface 196 on the upright 94.

The tube 180 can be readily placed on and removed from the particular member to which it attaches. The tube 180 is positively held in place. The tube 180 is a relatively low cost item that can be replaced when it wears out.

The foregoing disclosure of specific embodiments is intended to be illustrative of the broad concepts comprehended by the invention.

I claim:

1. An apparatus for elevating objects, said apparatus comprising:

a fame for bearing on a subjacent support surface for said apparatus;

a platform having an upwardly facing surface for bearing against an object to be elevated and laterally spaced sides;

means mounting the platform to the frame for movement of at least a part of the platform relative to the frame in a vertical direction between a lowered position and a raised position;

a flexible cord;

a winch mounted on said frame for selectively retrieving and paying out said flexible cord;

an elongate hollow conduit with spaced opposite ends;

means for mounting the conduit to the platform so that the conduit length is laterally directed with respect to the platform and so that the conduit spans substantially the entire distance between said platform sides, said flexible cord extending through and from the spaced opposite ends of the conduit; and means for connecting the flexible cord to the winch and frame and for causing a lifting force to be exerted at laterally spaced locations on the conduit by the flexible cord as the flexible cord is retrieved by the winch to thereby move the platform from the lowered position to the raised position, said conduit shielding the flexible cord along the lateral extent of said platform,

2. The apparatus for elevating objects according to claim 1 wherein said mounting means mounts the conduit beneath the upwardly facing platform surface.

3. The apparatus for elevating objects according to claim 1 wherein said platform has longitudinally spaced ends, the platform comprises a plurality of laterally spaced elongate rails extending in a longitudinal direction and said means mounting the conduit to the laterally spaced rails includes means for fixing the spacing between the laterally spaced rails.

4. The apparatus for elevating objects according to claim 1 including first and second cord guide inserts and means for mounting the cord guide inserts in the spaced ends of the conduit so that the lifting force from the flexible cord is exerted principally on the cord guide inserts.

5. The apparatus for elevating objects according to claim 4 wherein each said insert comprises a cylindrical body with an axial through bore that diverges toward its respective conduit end.

6. The apparatus for elevating objects according to claim 1 wherein means attach said winch to the frame above the conduit with the platform in the lowered position on one side of the platform, means are provided above the conduit with the platform in a lowered position for connecting the flexible cord to the frame on the other side of the platform and the flexible cord is extended from the winch through the conduit to the cord connecting means on the other side of the platform.

7. The apparatus for elevating objects according to claim 6 wherein said cord connecting means on the other platform side comprises a pulley, the cord is extended around the pulley and doubled back through the conduit and extended through the conduit end at the one side and a second means is provided on the frame on the one platform side for connecting that portion of the doubled back cord that extends through the conduit end at the one side.

8. The apparatus for elevating objects according to claim 1 wherein said conduit has a cylindrical outer surface and including a pulley and means for mounting the pulley in coaxial surrounding relationship with the cylindrical outer surface of the conduit and the cord is extended around the pulley on the conduit to reduce the force required to retrieve the cord on the winch.

9. A lift for a marine craft having a hull with an underside surface, said lift comprising:

a frame for bearing on a subjacent support surface;

a platform having an upwardly facing surface for bearing against the underside surface of a marine craft hull and laterally spaced sides;

means for connecting the platform to the frame for relative pivoting movement between a lowered position and a raised position;

an elongate hollow conduit having spaced opposite ends;

means for mounting the conduit to the platform so that the spaced conduit ends are at laterally opposite sides of the platform;

a flexible cord;

a winch for selectively retrieving and paying out flexible cord;

means for mounting the winch to the frame above at least a part of the upwardly facing platform surface with the platform in a lowered position;

means for connecting the flexible cord to the frame and for causing the cord to exert a force along the length of the conduit as the winch retrieves the cord as an incident of which the platform pivots relative to the frame between a lowered and a raised position, said conduit shielding the flexible cord from a marine craft on said platform and foreign matter along the lateral extent of said platform.

10. The lift for a marine craft according to claim 9 including means for fixing the cable to the frame and said fixing means is above at least a part of the upwardly facing platform surface with the platform in a lowered position.

11. The lift for a marine craft according to claim 10 wherein said winch and fixing means are on the same side of the platform.

12. The lift for a marine craft according to claim 10 wherein said winch and fixing means are on opposite sides of the platform.

13. The lift for a marine craft according to claim 9 wherein the conduit is beneath the upwardly facing platform surface.

14. The lift for a marine craft according to claim 9 wherein said platform has longitudinally spaced ends, the platform comprises laterally spaced elongate rails extending in a longitudinal direction and said means mounting the conduit to the laterally spaced rails includes means for fixing the spacing between the laterally spaced rails.

15. The lift for a marine craft according to claim 9 including first and second cord guide inserts and means mounting the cord guide inserts in the spaced ends of the conduit so that the lifting force from the flexible cord is exerted principally on the cord guide inserts 16. The lift for a marine craft according to claim 15 wherein each said insert comprises a cylindrical body with an axial through bore that diverges towards its respective conduit end.

17. The lift for a marine craft according to claim 9 wherein there is a pulley on the frame and the cord extends around the pulley.

18. The lift for a marine craft according to claim 9 wherein said conduit has a cylindrical outer surface and including a pulley and means for mounting the pulley in coaxial surrounding relationship with the cylindrical outer surface of the conduit and the cord is extended around the pulley on the conduit to reduce the force required to retrieve the cord on the winch.

* * * * *